US005472366A

United States Patent [19]

Moore

[11] Patent Number: 5,472,366

[45] Date of Patent: Dec. 5, 1995

[54] FLEXIBLE BRA CUP SUPPORT

[76] Inventor: Christine L. Moore, 565 Shorepines Pl., Coos Bay, Oreg. 97420

[21] Appl. No.: 202,757

[22] Filed: Feb. 28, 1994

[51] Int. Cl.[6] ..... A41C 3/12

[52] U.S. Cl. ..... 450/41; 450/49; 2/255; 2/256; 2/258

[58] Field of Search ..... 450/41, 42, 43, 450/44, 45, 46, 47, 48, 49, 50, 51, 52, 53, 54, 55, 56, 57; 2/73, 256, 257, 258, 264

[56] References Cited

U.S. PATENT DOCUMENTS 2,613,356 10/1952 Russell ..... 450/49
2,622,244 12/1952 Alberts ..... 450/49
2,895,481 7/1959 Spitzer ..... 450/52
3,035,584 5/1962 Menkel ..... 450/52
4,235,240 11/1980 Cousins ..... 450/52

*Primary Examiner*—Jeanette E. Chapman
*Attorney, Agent, or Firm*—Kenneth E. Darnell

[57] ABSTRACT

A flexible support element for fitting within a sleeve formed under and around the lower periphery of a bra cup, the invention replaces conventional bra underwires which lose shape during wear or washing, poke through sleeve material at the ends of the sleeve and cause user discomfort. The support element of the invention takes the form of an arcuate length of polymeric or similar material having a circular cross-sectional shape and which can be formed manually into a supporting shape to fit within the undercup sleeve. The present support element provides comfort to a user and does not poke through the ends of the undercup sleeve.

11 Claims, 3 Drawing Sheets

FLEXIBLE BRA CUP SUPPORT

BACKGROUND OF THE INVENTION

1. Field of the Invention

The invention relates to supports for the cup portions of bras, swimwear and other articles of apparel which utilize bust-supporting structures, and particularly relates to a flexible cup support element formed of polymeric or similar material and having a circular cross-section, the support element replacing conventional underwire structures.

2. Description of the Prior Art

Devices intended to provide support and shaping for the cup of a bra have long been known especially for larger cup sizes. Such devices have come to be commonly known as "underwires" even when formed of material other than metal. Over at least the last fifty years, these underwires have taken many shapes and have been formed of many different materials. The underwire itself is commonly inserted into and held within a fabric sleeve disposed about the periphery of the bra cup at least about the lower half thereof. The relatively bulky and thick underwires used over half a century ago have given way in the present day to underwires formed of relativley thin, flat lengths of metal having generally a rectangular cross-section. These metal structures are shaped into an almost semi-circular conformation which allows fitting of the underwire within the sleeve disposed about the periphery of the under side of the bra cup. These metal underwires are often coated with various "plastic" materials and often have plastic tips located at each end of the underwire. Such structures are shown in U.S. Pat. Nos. 3,605,753 and 4,133,316 with structures described in these patents being produced by S & S Industries, Inc. of New York, N.Y. Underwires formed of plastic materials only have also been provided in the art as is evidenced by a Playtex product formed solely of plastic material and having a substantially oval cross-section. While these prior underwire structures have achieved widespread usage, certain disadvantages result from their use. In particular, the underwire structures formed of metal, especially those structures not having cushioning tips, can cut into the skin of a user producing substantial discomfort. Even the underwire structures provided with cushioning tips push through or "poke through" the normally closed ends of the fabric sleeve intended to hold the underwire structures, thereby requiring that the sleeve be repaired or that the bra discarded due to the damage caused by poke through of the underwire structure which destroys at least portions of the fabric of the bra. Washing of bras having conventional underwire structures as described above and especially in automatic washing machines and the like cause deformation of the underwire especially when formed of metal and often results in poke through. Multiple washings eventually destroy bras fitted with conventional underwires, degradation of the fabric of the bra occurring at least in part due to the relative movement occurring between the stiff, rigid metal underwire and the fabric of the bra occasioned by the mechanical actions encountered in machine washing and drying.

Conventional underwires thus exhibit substantial deficiencies in use owing primarily to wearer discomfort and bra degradation due to the rigid and relatively unyielding nature of these structures. Prior efforts have been made to improve underwire structures with attention being directed to at least certain of the problems inherent in conventional underwires as have been discussed above. O'Boyle, in U.S. Pat. No. 4,646,746 forms an underwire of polymeric material which appears to be elastomeric in at least some degree. O'Boyle provides various shapes for these underwire support elements. The patent to Menkel, U.S. Pat. No. 3,035,584 provides plastic support elements having flattened cross-sectional configurations. In U.S. Pat. No. 3,114,374, Chalfin et al describe polymeric materials encasing a wire in an underwire support. Rowell, in U.S. Pat. No. 3,209,756, also encases a wire with a polymeric material in an effort to remedy the problems encountered with underwire structures formed of metal. Schwartz, in U.S. Pat. No. 3,378,012, provides a metal wire support having a rectangular cross-section. However, Schwartz mentions the potential formation of a metal wire support with a circular cross-section. While the prior art provides underwire support structures of varying description, the art has yet to provide a lightweight underwire structure capable of providing shape and support while being comfortable to a user even after numerous washings and dryings of the bra in which the underwire support is provided. Further, in spite of tips formed on conventional underwires which are intended to prevent poke through and user discomfort, the art has yet to provide a satsifactory underwire structure which will not poke through the fabric sleeve within which underwires are carried even after multiple washings and which will not cause discomfort to a user. The present invention is intended to provide an underwire structure formed of polymeric or similar material and having a circular cross-sectional shape, this structure being lightweight and comfortable to a user while reducing the potential for damage to the fabric of the bra due to poke through or excessive wearing during machine washing and drying.

SUMMARY OF THE INVENTION

The invention provides an improved support element such as is commonly disposed about at least the lower periphery of a bra cup to facilitate shaping and support of that portion of a user's body which is intended to fit within a bra cup. Such support elements are commonly known as "underwires" and are conventionally formed of metal, plastic-coated metal and plastic materials having various cross-sectional shapes. The present support elements or "underwires" are formed of polymeric or similar materials which are capable of being shaped to conform to the contours of a bra cup and that portion of a user of the bra which fits into the bra cup. The material from which the present support elements are formed are sufficiently rigid to maintain a particular shape once manually formed and, if deformed from a desired shape, can be reformed manually with little effort. Various polymeric and elastomeric materials can be employed with common materials such as polyvinylchloride typically being used. For the purposes of this disclosure, the term "plastic" will refer to those polymeric materials useful according to the invention.

The present support elements further are provided with a circular cross-section since this particular shape has been found to provide substantial benefits in causing the support elements to be comfortable to a user and to resist damage to the fabric of the bra including the fabric from which a sleeve is formed about the under periphery of a bra cup for receiving a support element. The ends of a support element configured according to the invention can be rounded to further reduce the potential for discomfort due to contact between the ends of the support element and the skin of a user. Still further, rounded ends on a support element configured according to the invention can further reduce the potential for poke through, that is, the poking of an end of an underwire structure through an end of that fabric sleeve formed about a bra cup which receives an underwire structure thereinto for holding the underwire structure in proximity to the desired body portion of a user.

Accordingly, it is an object of the invention to provide improved support elements known as underwire structures used for support and shaping in a bra and wherein the support element is formed of a flexible polymeric or similar material and which particularly has a circular cross-sectional shape.

It is another object of the invention to provide an improved underwire structure for a bra cup and which reduces user discomfort associated with conventional underwire structures and which also reduces "poke through" of the underwire structure through the fabric material at the ends of a sleeve into which the underwire structure is inserted for holding of the underwire structure in place.

It is a further object of the invention to provide an improved support element or underwire structure for bras which allows multiple machine washings and dryings with minimal deformation of the support element and minimal damage to the fabric of the bra itself.

Further objects and advantages of the invention will become more readily apparent in light of the following detailed description of the preferred embodiments.

DESCRIPTION OF THE PREFERRED EMBODIMENTS

Figure 2A:
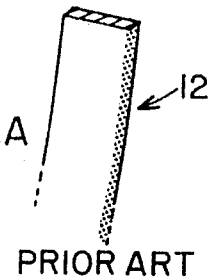
FIG. 2A is a detailed perspective view of a conventional metal underwire structure.
Figure 1:
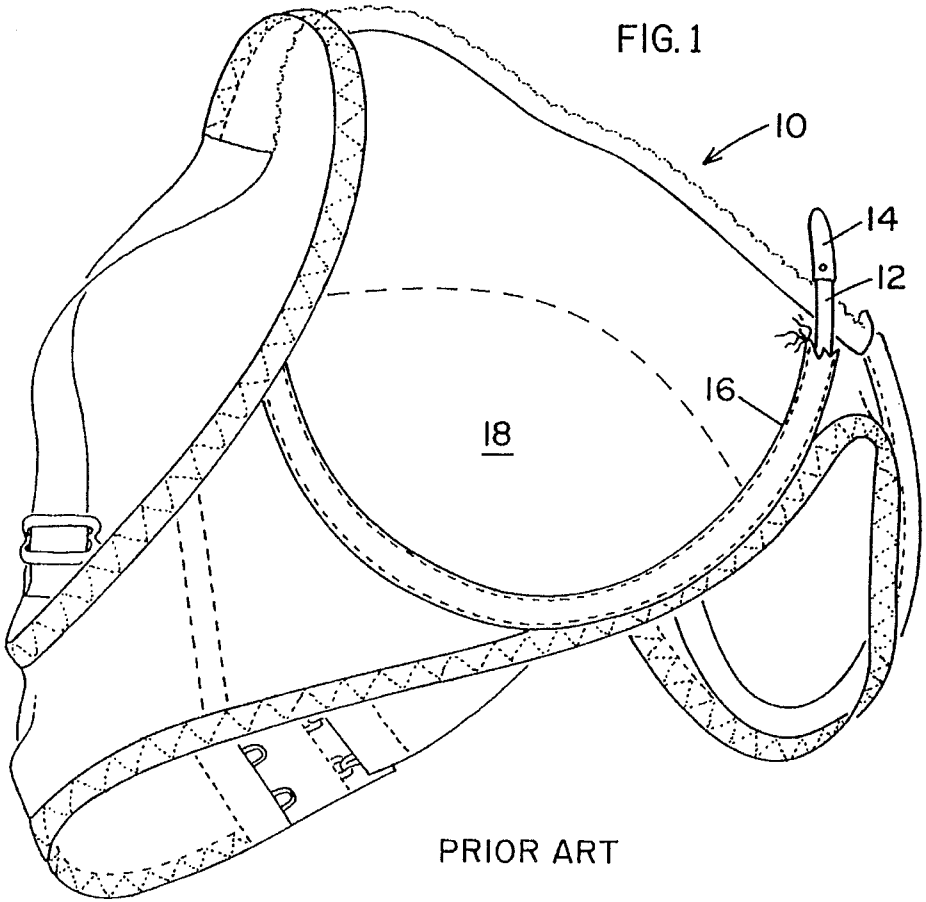
FIG. 1 is a perspective view of a conventional underwire structure positioned in a bra, an end of the conventional underwire structure being seen as having poked through an end of a sleeve within which the conventional underwire structure is disposed.

Referring now to the drawings and particularly to FIG. 1 and FIGS. 2A through 2C, a bra is shown generally at 10 to be provided with a conventional underwire 12 which is formed of an arcuate metal bar such as is seen generally in FIG. 2A. This conventional underwire 12 is the most common underwire structure available in today's marketplace, the metal body of the underwire 12 having a substantially rectangular cross-sectional shape as is best seen in FIG. 2A. As can be seen in FIG. 1, a tip 14 is provided at the exposed end of the underwire 12, this tip 14 being formed of a plastic material, that is, a polymeric material, and being rounded at its end in an effort to reduce the tendency of metal underwire structures to poke through the ends of a sleeve 16 in which the underwire 12 fits. As can be seen in FIG. 1, the end of the underwire 12 has poked through the end of the sleeve 16 in spite of the use of the tip 14 having a rounded end portion. The situation as shown in FIG. 1 is a very common problem associated with conventional underwire structures. Further, the ends of a conventional underwire structure such as the underwire 12 jab into the flesh of a wearer of the bra 10 and cause further discomfort. The shape of the body of the underwire 12 further acts to chafe the skin of a user and thus cause significant discomfort. Although not shown in FIG. 1, the body of the conventional underwire 12 extends into and substantially throughout the sleeve 16 which is arcuate in conformation and typically formed of a fabric material. The end of the underwire 12 opposite the exposed end of said underwire 12 is also provided with a tip such as the tip 14 although this structure is not shown in FIG. 1. As is conventional in the art, the sleeve 16 extends about the lower periphery of the cup 18 and is intended to hold the conventional underwire 12 in place.

Figure 2B:
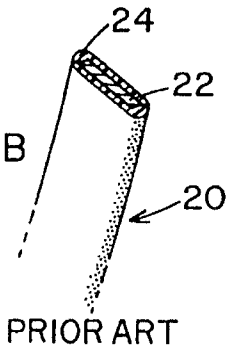
FIG. 2B is a detailed perspective of a conventional underwire structure having a metal interior and a polymeric or plastic coating formed thereon.

In FIG. 2B, another conventional underwire is seen at 20 to be formed of a metal wire 22 having a substantially rectangular cross-section, the wire 22 being coated with a plastic material forming cover 24. In this structure, the intent of the combination of the wire 22 with the plastic cover 24 is to provide greater comfort to a user while reducing the poke through problems encountered with the conventional underwire 12 of FIG. 2A. Such prior art structures as are shown in FIG. 2B do not prove to be satisfactory in eliminating these problems.

Figure 2C:
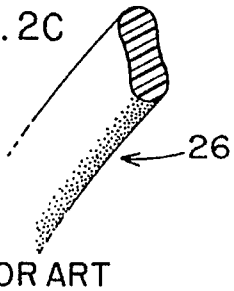
FIG. 2C is a detailed perspective of a conventional underwire structure formed of a polymeric material.

Referring now to FIG. 2C, an underwire structure of conventional design is seen at 26 to be formed entirely of a plastic material and to have a substantially "barbell" shape, this structure also being intended to provide greater comfort to a user while reducing those problems inherent in the use of underwire structures such as the conventional metal underwire 12. Underwire structures such as the underwire 26 of FIG. 2C have not improved user comfort and further have been shown to break apart when attempts are made to mold the structure to a necessary supporting shape.

Figure 3:
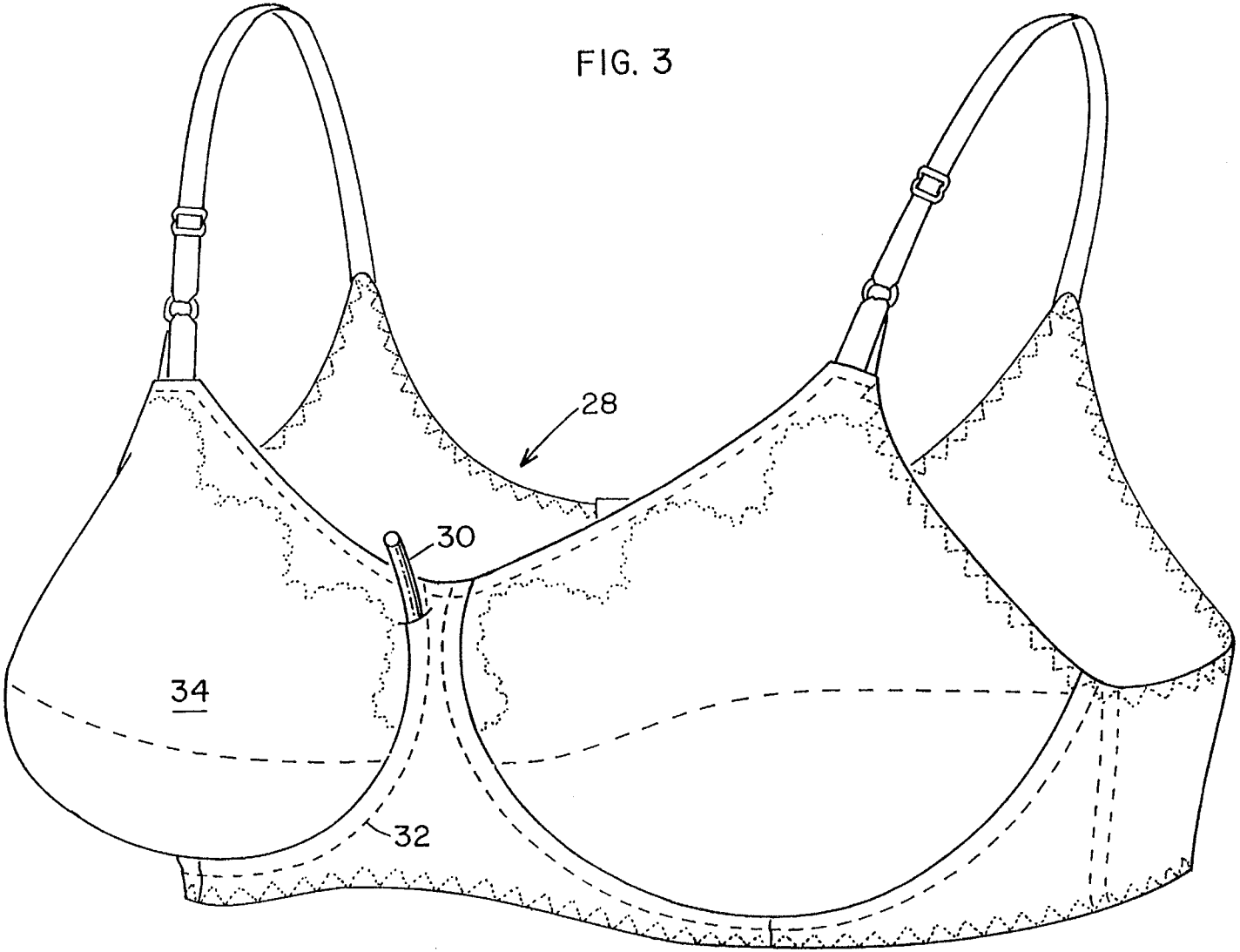
FIG. 3 is a perspective of a bra having a support element or underwire structure configured according to the invention used in association with the bra.
Figure 4:
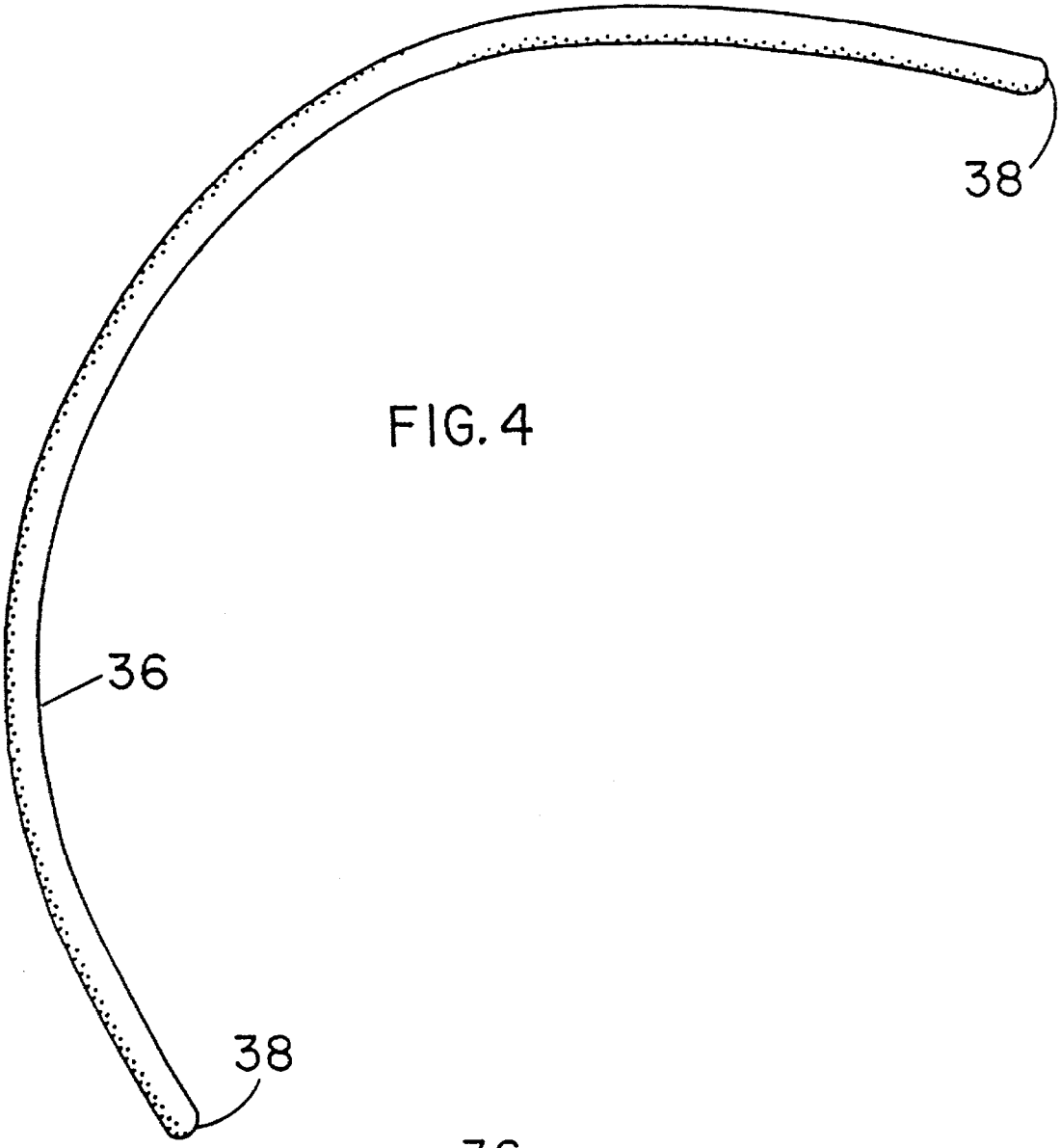
FIG. 4 is a perspective view of an underwire structure formed according to the invention; and, FIG. 5 is a detailed perspective view of a second embodiment of an underwire structure formed according to the invention.
Figure 5:
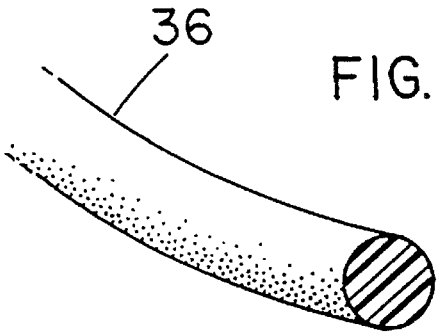

Referring now to FIGS. 3 through 5, a bra 28 such as is of conventional design is seen to be formed with a sleeve 32 formed of fabric material and disposed about the lower periphery of cup 34. As such, the bra 28 is of conventional design. A support element 30 configured according to the invention can be seen in FIG. 3 to be received within the sleeve 32, an end portion of the support element 30 being shown as extending through one end of the sleeve 32 to illustrate the location of the support element 30 in relation to the cup 34. In practice, the support element 30 would be pushed further into the sleeve 32 and the end of the sleeve 32 sewn to maintain the support element 30 therewithin. The cross-sectional shape of the support element 30 is circular or substantially so in order to provide greater comfort to the wearer of the bra 28 and to resist damage to the fabric sleeve 32 both in use and during washing and drying and especially machine washing and drying. The support element 30, formed of polymeric or plastic material, resists pushing through the ends of the sleeve 32 as occurs with a conventional underwire structure such as has been described relative to the conventional underwire 12 of FIG. 1. Although the illustration of FIG. 5 is intended to show the cross-section of support element 36 which is best seen in FIG. 4, the cross-section of the support element 30 is substantially the same as the cross-sectional shape of the support element 36.

Referring particularly to FIGS. 4 and 5, the support element 36 is seen to be provided with rounded ends 38 rather than the non-rounded ends of the support element 30 as seen in FIG. 3. The support elements of the present invention can be formed either with or without rounded end portions and will function to provide substantial comfort to a user and to virtually eliminate poke through problems and other damage to the fabric of a bra such as are encountered with conventional underwire structures. The advantages of the present support elements 30 and 36 occur by virtue of the formation of said elements 30 and 36 from substantially flexible polymeric materials which are formed with substantially circular cross-sectional shapes. This choice of material and cross-sectional shape is seen to provide the substantial use advantages of the invention.

While the diameter of the present support elements can be taken to be any diameter which functions to provide support, comfort and resistance to damage to the bra, a typical diameter for a support element according to the invention will be less than one-quarter inch in diameter and typically approximately 3/16" in diameter to 1/8" in diameter for bras having cup sizes of 34B and greater. Smaller bra sizes and cup sizes typically are capable of utilizing support elements of lesser diameter. However, in practice, a diameter of less than 1/8" is not practical even though a diameter of 1/16" can be successfully employed.

As indicated hereinabove, the material from which the support elements of the invention are to be formed include plastic material such as high density polyethylene, chlorinated and fluorinated hydrocarbons such as Teflon and other materials which are flexible in use when formed to those shapes used for underwire structures. It is important that the support elements 30 and 36 be capable of being shaped manually to an arcuate conformation such as is necessary for fitting into fabric sleeves disposed about the periphery of the underside of bra cups. The support elements 30 and 36 are intended to retain the arcuate shape necessary for the intended use. Prior to insertion of either of the support elements 30 and 36 into the sleeve 32, the support elements 30 and 36 are seen to be generally arcuate in shape, the support elements 30 and 36 being capable of being shaped while within the sleeve 32 to a contour capable of supporting a portion of the body of the user which is received into the cup 34, the support elements 30 and 36 retaining that supporting contour while within the sleeve 32. As is indicated herein, the support elements 30 and 36 are substantially non-rigid and have body portions having circular cross-sections.

In a series of tests involving user acceptance of the present support elements, a support element configured according to the shape and size of the support element 36 as described herein was utilized about one cup of a bra and a conventional underwire such as the underwire 12 fitted with the tip 14 as is seen in FIG. 1 was provided around the other cup of the bra. In use extending over a period of three months, a total of seven users wearing a bra so fitted reported support provided by the support elements of the invention to be as good or better than the support provided by the conventional underwire structures, much greater comfort provided by the present support elements when compared to conventional underwire structures and no damage to the structure of the bras either due to poke through or damage during machine washing and drying. In each test, a pronounced preference for the present support elements was indicated by the individual participating in the testing program.

While the invention has been described herein primarily as a support element for a cup used in a bra, it is to be understood that the invention can be utilized as a support element in bust-supporting cup structures which comprise portions of swimwear and other articles of clothing wherein bust support is desired. In these several use environments, the present support elements provide not only support but also provide substantially increased comfort to a user at least in part due to the fact that the ends of the present support elements do not "work" through apparel casings and cut into the skin of a user. Since the present support elements do not poke through a casing thus destroying a portion of the item of apparel, the invention causes such apparel to exhibit substantially increased longevity in use as well as improved wearability.

The present support elements provide substantial advantages over conventional underwire structures especially as regards user comfort and reduction of damage to the fabric of a conventional bra. The advantages provided by the present support elements accrue primarily due to the material from which the present support elements are formed and that cross-sectional shape which is preferred according to the invention. This particular combination of structural features produces an unexpected and beneficial result in the use of underwire structures for providing support and comfort to a user of an otherwise conventional underwire bra. Accordingly, the scope of the invention will be seen as defined by the following recitations of the invention.

What is claimed is:

1. A support element for use with a bust-supporting article of apparel having at least one cup with a sleeve disposed about at least lower portions of the cup and into which sleeve is received the support element, the support element being intended to hold a desired shape of the cup, the support element comprising an elongated body portion formed of a plastic material, said support element being generally arcuate prior to insertion of the support element into the sleeve, the support element further being substantially non-rigid and wherein the body portion has a circular cross-section, the support element being capable of being shaped while within the sleeve to a contour capable of supporting a portion of the body of a user which is received into the cup, the support element retaining that supporting contour while within the sleeve.

2. The improved support element of claim 1 wherein the ends of the body portions are rounded.

3. The improved support element of claim 1 wherein the plastic material comprises a polymeric material.

4. The improved support element of claim 3 wherein the plastic material is selected from the group consisting of high density polyethylene, fluorinated hydrocarbons and chlorinated hydrocarbons.

5. The improved support element of claim 1 wherein the circular cross-section of the body portion of the support element has a diameter ranging from 1/16" to 1/4".

6. The improved support element of claim 1 wherein the circular cross-section of the body portion of the support element has a diameter of 3/16".

7. The improved support element of claim 1 wherein the circular cross-section of the body portion of the support element has a diameter of 1/8".

8. The improved support element of claim 1 wherein the support element has a cross-sectional diameter which is slightly less than the internal diameter of the sleeve to allow the support element to be received loosely within the sleeve.

9. The improved support element of claim 1 wherein the plastic material is selected from the group consisting of high density polyethylene, fluorinated hydrocarbons and chlorinated hydrocarbons.

10. The improved support element of claim 1 wherein the support element is not preformed into a rigidly maintained shape prior to insertion of the support element into the sleeve.

11. A support element for use with a bust-supporting article of apparel having at least one cup with a sleeve disposed about at least lower portions of the cup and into which sleeve is received the support element, the support element being shaped while within the sleeve to a contour capable of supporting a portion of the body of a user received into the cup, the support element comprising an elongated body portion formed of a plastic material capable of being shaped into that contour for supporting the user, the body portion of the support element being substantially non-rigid and having a circular cross-section, the support element being capable of being shaped while within the sleeve to that contour supporting the user and further being capable of retaining that supporting contour while within the sleeve.

* * * * *